US011572770B2

(12) United States Patent
Sengul et al.

(10) Patent No.: US 11,572,770 B2
(45) Date of Patent: Feb. 7, 2023

(54) SYSTEM AND METHOD FOR DETERMINING LOAD AND DISPLACEMENT OF A POLISHED ROD

(71) Applicant: Noven, Inc., Houston, TX (US)

(72) Inventors: Mahmut Sengul, Houston, TX (US); Mario Ruscev, Houston, TX (US)

(73) Assignee: NOVEN, INC., Houston, TX (US)

( * ) Notice: Subject to any disclaimer, the term of this patent is extended or adjusted under 35 U.S.C. 154(b) by 206 days.

(21) Appl. No.: 16/898,050

(22) Filed: Jun. 10, 2020

(65) Prior Publication Data

US 2020/0392822 A1 Dec. 17, 2020

Related U.S. Application Data

(60) Provisional application No. 62/859,958, filed on Jun. 11, 2019.

(51) Int. Cl.

| | |
|---|---|
| ***F04B 47/02*** | (2006.01) |
| ***E21B 43/12*** | (2006.01) |
| ***F04B 49/06*** | (2006.01) |

(52) U.S. Cl.

CPC ..... *E21B 43/12* (2013.01); *F04B 47/026* (2013.01); *F04B 49/06* (2013.01); *F04B 2201/121* (2013.01)

(58) Field of Classification Search

CPC ..... E21B 43/12; F04B 47/026; F04B 49/06; F04B 2201/121

See application file for complete search history.

(56) References Cited

U.S. PATENT DOCUMENTS

| | | | | |
|---|---|---|---|---|
| 3,343,409 | A | 9/1967 | Gibbs | |
| 3,464,276 | A | 9/1969 | Leibert | |
| 3,965,736 | A * | 6/1976 | Welton | E21B 47/007 73/152.61 |
| 4,090,405 | A * | 5/1978 | McKee | G01L 5/102 73/788 |
| 4,490,094 | A | 12/1984 | Gibbs | |
| 4,509,901 | A | 4/1985 | McTamaney et al. | |
| 4,644,785 | A * | 2/1987 | Doyle | F04B 47/026 73/781 |
| 5,252,031 | A | 10/1993 | Gibbs | |
| 5,941,305 | A | 8/1999 | Thrasher et al. | |

(Continued)

FOREIGN PATENT DOCUMENTS

AU 2004316883 B2 7/2008

*Primary Examiner* — Taras P Bemko

(74) *Attorney, Agent, or Firm* — MH2 Technology Law Group LLP

(57) ABSTRACT

An apparatus includes a body. The body includes first and second clamping mechanisms that are configured to grip a tubular member of a beam pump unit at first and second axially-offset locations along the tubular member, respectively. The body also includes a base positioned at least partially between the first and second clamping mechanisms. The apparatus also includes a strain gauge coupled to the base and configured to measure a strain on the tubular member as the tubular member moves. The apparatus also includes a gyroscope configured to measure an orientation, an angular velocity, or both of the beam pump unit as the beam pump unit operates. The apparatus also includes an accelerometer configured to measure an acceleration of the beam pump unit as the beam pump unit operates.

20 Claims, 5 Drawing Sheets

(56) References Cited

U.S. PATENT DOCUMENTS

| | | | | |
|---|---|---|---|---|
| 6,176,682 | B1 | 1/2001 | Mills | |
| 8,157,537 | B2 | 4/2012 | Chavez | |
| 9,506,751 | B2 | 11/2016 | Zhao | |
| 2004/0144529 | A1 | 7/2004 | Barnes et al. | |
| 2011/0185825 | A1* | 8/2011 | Mackie | E21B 47/00 166/381 |
| 2012/0020808 | A1 | 1/2012 | Lawson et al. | |
| 2013/0030721 | A1 | 1/2013 | Palka et al. | |
| 2013/0333880 | A1 | 12/2013 | Raglin et al. | |
| 2015/0176395 | A1 | 6/2015 | McCoy | |
| 2015/0308257 | A1 | 10/2015 | McCoy et al. | |
| 2015/0345280 | A1 | 12/2015 | Krauss | |
| 2016/0138949 | A1* | 5/2016 | Zhao | E21B 43/127 73/781 |
| 2017/0159422 | A1 | 6/2017 | McCoy | |
| 2017/0306745 | A1* | 10/2017 | Harding | F04B 47/028 |
| 2017/0363079 | A1* | 12/2017 | Baker | F04B 49/02 |
| 2018/0217015 | A1* | 8/2018 | Baker | G01L 5/0061 |
| 2019/0203579 | A1* | 7/2019 | Phillips | F04B 51/00 |
| 2020/0123892 | A1* | 4/2020 | Picon | E21B 43/127 |
| 2020/0263531 | A1* | 8/2020 | Fyfe | H04Q 9/00 |
| 2021/0115914 | A1* | 4/2021 | Zhao | G01D 5/244 |

* cited by examiner

SYSTEM AND METHOD FOR DETERMINING LOAD AND DISPLACEMENT OF A POLISHED ROD

CROSS-REFERENCE TO RELATED APPLICATIONS

This application claims priority to U.S. Patent Application No. 62/859,958, filed on Jun. 11, 2019, the entirety of which is incorporated by reference herein.

BACKGROUND

Beam pumping is the most widely used type of artificial lift method for oil and gas wells. Typical methods for analyzing the performance of the beam pump unit are based on Gilbert's development of the beam pump dynamometer. Using those methods, the load on the polished rod is recorded graphically as a function of its travel to generate a chart that shows the work undertaken at the surface unit for each pump stroke.

With the advent of high-performance digital data acquisition systems, attention has been directed to a more complete analysis of the performance of the beam pump unit. However, traditional supervisory control and data acquisition (SCADA) systems generally have a large footprint at the wellsite, and rely on a costly field-level, local telecommunication infrastructure. In addition, such SCADA systems are oftentimes not compatible with computing systems used at the wellsite. Therefore, it would be beneficial to have an improved system and method for analyzing the performance of a beam pump unit.

SUMMARY

An apparatus for determining a performance of a beam pump unit is disclosed. The apparatus includes a body. The body includes first and second clamping mechanisms that are configured to grip a tubular member of the beam pump unit at first and second axially-offset locations along the tubular member, respectively. The body also includes a base positioned at least partially between the first and second clamping mechanisms. The apparatus also includes a strain gauge coupled to the base and configured to measure a strain on the tubular member as the tubular member moves. The apparatus also includes a gyroscope configured to measure an orientation, an angular velocity, or both of the beam pump unit as the beam pump unit operates. The apparatus also includes an accelerometer configured to measure an acceleration of the beam pump unit as the beam pump unit operates.

A system for determining the performance of the beam pump unit is also disclosed. The system includes a body. The body includes a first clamping mechanism configured to grip a rod of the beam pump unit at a first location along the rod. The system also includes a second clamping mechanism configured to grip the rod at a second location along the rod that is axially-offset from the first location. The system also includes a base positioned at least partially between the first and second clamping mechanisms. The base has a bore formed at least partially therethrough, such that the base defines first and second thin segments on either side of the bore. The system also includes a strain gauge coupled to the base proximate to the bore. The strain gauge is configured to measure a strain on the rod as the rod moves. The system also includes a gyroscope coupled to the body and configured to measure an orientation, an angular velocity, or both of the rod as the rod moves. The system also includes an accelerometer coupled to the body and configured to measure an acceleration of the rod as the rod moves. The system also includes an enclosure coupled to the body. The system also includes a circuit positioned within the enclosure. The circuit is configured to receive measurements from the strain gauge, the gyroscope, and the accelerometer. The system also includes a transceiver positioned within the enclosure. The transceiver is configured to wirelessly transmit the measurements to an external computing system.

A method for determining the performance of the beam pump unit is also disclosed. The method includes coupling an integrated sensor to a polished rod of a beam pump unit. The integrated sensor includes a body. The body includes a first clamping mechanism configured to be coupled to the polished rod at a first location along the polished rod. The body also includes a second clamping mechanism configured to be coupled the polished rod at second location along the polished rod that is axially-offset from the first location. The body also includes a base positioned at least partially between the first and second clamping mechanisms. A bore is defined at least partially through the base. The integrated sensor also includes a strain gauge coupled to the body proximate to the bore. The integrated sensor also includes a gyroscope coupled to the body. The integrated sensor also includes an accelerometer coupled to the body. The method also includes measuring a strain parameter using the strain gauge. The method also includes measuring a gyroscopic parameter using the gyroscope. The method also includes measuring an acceleration parameter using the accelerometer.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

The present disclosure is directed to a system and method for determining the performance of a beam pump unit. More particularly, the system and method may be configured to measure parameters of a polished rod of a beam pump unit used in oil and gas wells. The measurements may provide data about the efficiency and health conditions of a subsurface pump and rod string that are part of the beam pump unit.

Figure 1:
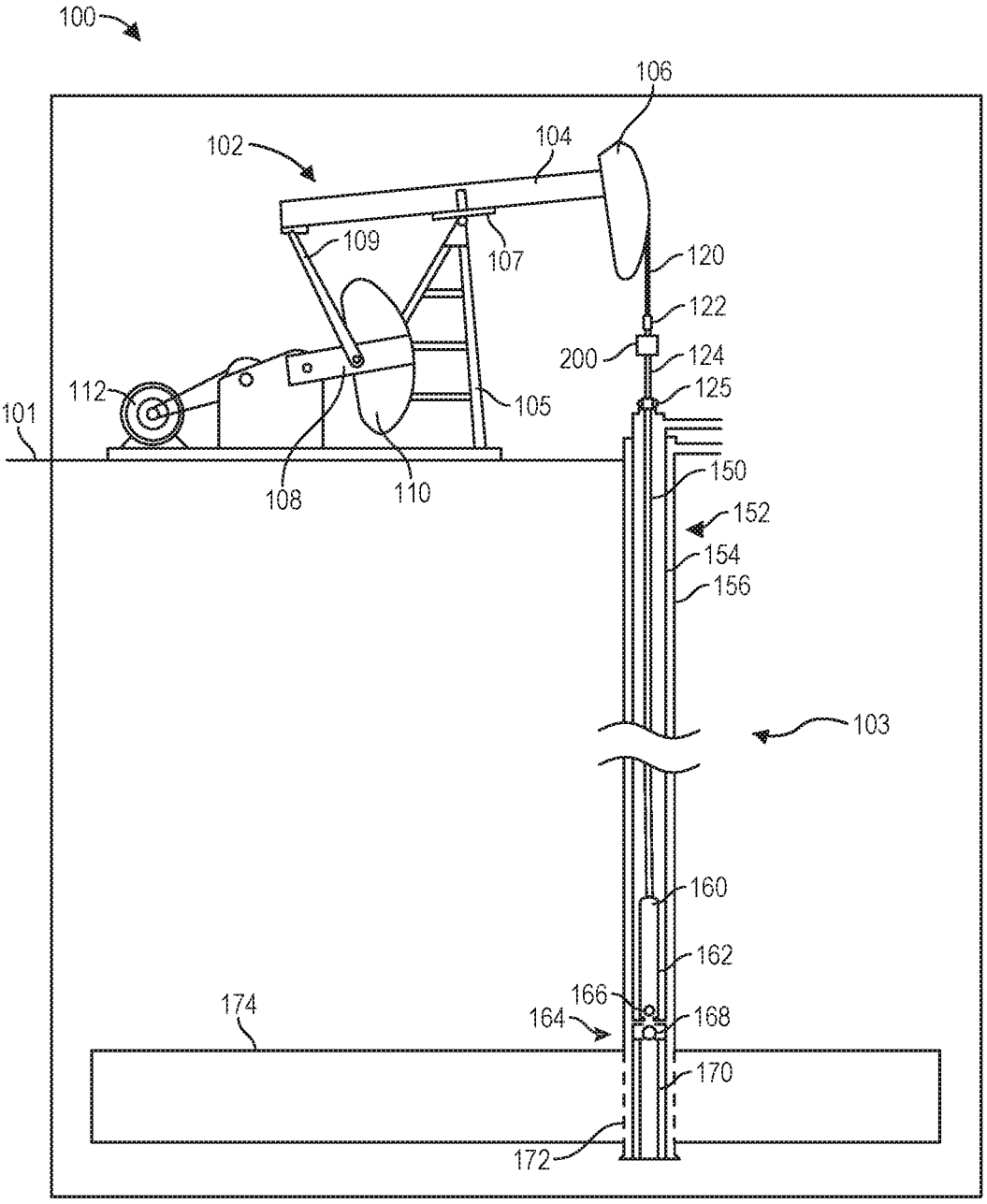
FIG. 1 illustrates a schematic view of a beam pump unit, according to an embodiment.

FIG. 1 illustrates a schematic view of a beam pump unit 100, according to an embodiment. The beam pump unit 100 may include a surface system 102 and a downhole system 103. The surface system 102 may include a walking beam 104 having a horsehead 106 connected at a distal end thereto. The walking beam 104 may be supported from the ground 101 by a samson post 105 connected to the walking beam 104 via a center bearing 107. At a proximal end of the walking beam 104, a pitman arm 109 may connect the walking beam 104 to a crank arm 108. The crank arm 108 may include a counterbalance weight 110, and may be driven by a prime mover 112, such as an internal-combustion engine. The prime mover 112 causes the crank arm 108 to move through an arc, generally up and down with respect to the ground 101. In turn, this drives the walking beam 104 to pivot about the center bearing 107, causing the horsehead 106 to move through an arc, generally up-and-down with respect to the ground 101.

A bridle 120 may be coupled to the horsehead 106, and may be connected via a carrier bar 122 to a polished rod 124. The polished rod 124 may connect the surface system 102 with the downhole system 103. A stuffing box 125 (and/or other components of a wellhead) may prevent egress of fluids, gasses, etc. from the downhole system 103 along the polished rod 124. The downhole system 103 may include sucker rods 150 that extend down through a wellbore 152, e.g., through production tubing 154 and a casing 156 disposed in the wellbore 152. A plunger 160 may be connected to a lower end of the sucker rods 150. The plunger 160 may fit into a pump barrel 162, and a valve system 164 (e.g., a travelling valve 166 and a standing valve 168) may be positioned at or near to the lower end of the sucker rods 150. A gas anchor 170 may be positioned at the bottom of the wellbore 152, e.g., near perforations 172 formed therein, which may provide a communication path for fluids, e.g., hydrocarbons, in a subterranean reservoir 174. Accordingly, as the surface system 102 operates to move the horsehead 106 up and down, this movement is transmitted via the bridle 120, carrier bar 122, and polished rod 124 to the sucker rods 150. In turn, the sucker rods 150 apply pressure into the wellbore 152, which tends to draw fluid upward in the production tubing 154, enabling production of fluid, e.g., hydrocarbons, from the perforations 172 to the surface.

The polished rod 124 is configured to cycle up and down by a predetermined vertical distance, in response to movement of the horsehead 106. As mentioned above, there are a variety of ways to measure or infer the position of the polished rod 124, or a point thereof. For example, proximity sensors, optical sensors, magnetic sensors, Hall-effect sensors, etc. may be used to directly measure a position of the polished rod 124. In other embodiments, encoders, pickups, etc. attached to the prime mover 112, the crank shaft, or the like, may also be employed to measure the position of the polished rod 124. Further, sensors that are configured to measure load on the polished rod 124 may be employed, e.g., including strain gauges. In some embodiments, an integrated sensor 200 may be coupled to the polished rod 124 to measure the position of the polished rod 124, as well as the loads incident thereon. Such sensors may include strain gauges, and may be positioned between the polished rod 124 and the carrier bar 122 or attached directly to the polished rod 124. Examples of integrated sensors 200 that may be attached directly to the polished rod 124 include those disclosed in U.S. patent application Ser. Nos. 16/897,566 and 16/897,639, assigned to the assignee of the present application and incorporated herein by reference in their entirety. The integrated sensor 200 (or two or more separate sensors) may be employed to generate a surface dynamometer card ("surface dynacard").

Figure 2:
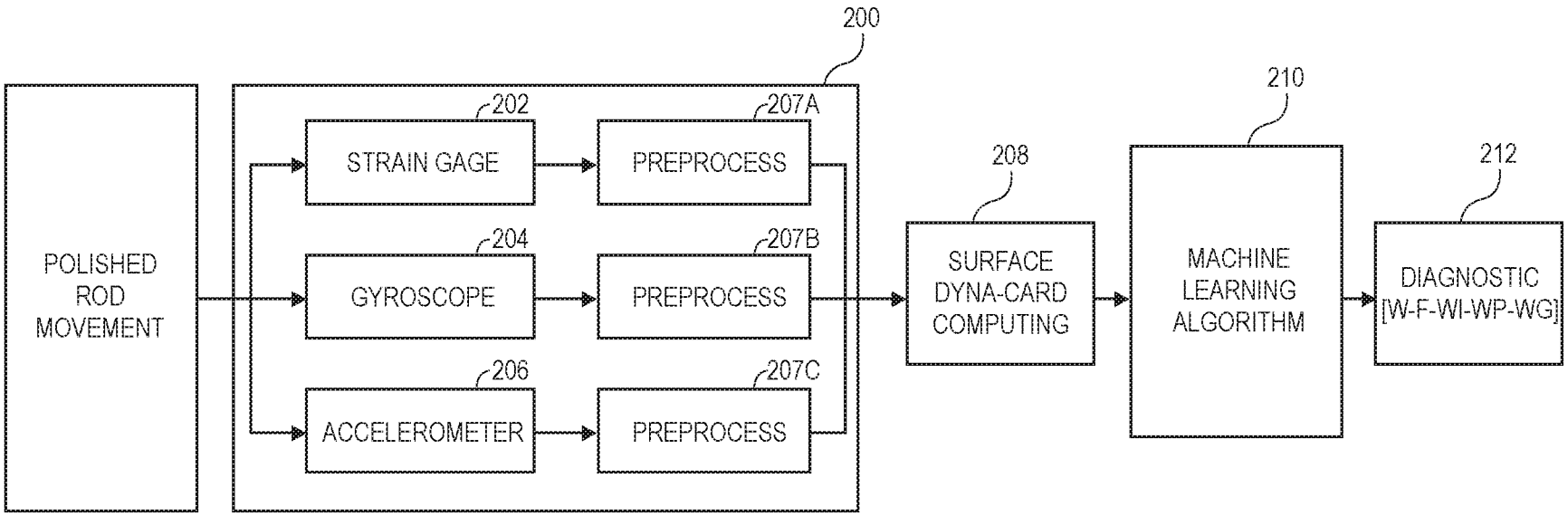
FIG. 2 illustrates a schematic view of a system for determining the performance of the beam pump unit, according to an embodiment.

FIG. 2 illustrates a schematic view of a system for determining the performance of the beam pump unit 100, according to an embodiment. As shown, the integrated sensor 200 includes a strain gauge 202, gyroscope 204, and accelerometer 206 which may be positioned on the polished rod 124 and configured to acquire load, orientation, and acceleration data over time.

The strain gauge 202 measures the change in length of at least a portion of the polished rod 124 due to the load variation during the upstroke and/or downstroke of the polished rod 124. The change in length may be measured as an analog voltage value (e.g., in millivolts), which may be converted to a digital value by an analog-to-digital converter (ADC). The digital value may be transmitted to an external computing system (e.g., a wellsite gateway) using a transceiver. For example, the digital value may be transmitted using BLUETOOTH® very-low-energy (BLE) communication. The data (e.g., digital voltage values) may be time-stamped. The digital voltage values may be converted to load values and/or strain values using a calibration chart/ table that is specific to the strain gauge 202. The values may be used as part of a dynamometer survey. The dynamometer survey may be used to analyze volumetric efficiency of the subsurface pump and/or the well, as well as the mechanical integrity and operating efficiency of the subsurface pump.

The load measurement may not be the absolute load carried by the polished rod 124. In at least one embodiment, the load measurement may be a measurement of the change in the load (e.g., delta load) during the upstroke and/or the downstroke. As the polished rod 124 may always be under tension, even when stationary, the load may never be zero. Thus, in one example, the zero point may be set when the pump completes the downstroke. Rod dimensions, grade, body yield, and metallurgical composition may be factored into the measurements. Calibration tests may be performed using rods having a diameter of 1 inch, 1.25 inches, and 1.5 inches.

The gyroscope 204 may be or include a three-axis micro-electro-mechanical system (MEMS) gyroscope 204. The gyroscope 204 may be part of the integrated sensor 200 and coupled to the strain gauge 202, the polished rod 124, or another moving component of the beam pump unit 100. The gyroscope 204 is configured to measure an orientation and/or angular velocity of the polished rod 124 or another moving component of the beam pump unit 100 during operation. The orientation and/or angular velocity may be measured as an analog voltage value (e.g., in millivolts), which may be converted to a digital value by the ADC. The digital value may be transmitted to the external computing system using the transceiver. For example, the digital value may be transmitted using BLE communication. The data (e.g., digital voltage values) may be time-stamped. The digital voltage values may be converted to orientation and/or angular velocity values using a calibration chart/table that is specific to the gyroscope 204. The orientation and/or angular velocity values may be used as part of the dynamometer survey. The dynamometer survey may be used to analyze volumetric efficiency of the subsurface pump and/or the well, as well as the mechanical integrity and operating efficiency of the subsurface pump.

The accelerometer 206 may be or include a three-axis MEMS accelerometer 206. The accelerometer 206 may be coupled to the strain gauge 202, the gyroscope 204, the polished rod 124, or another moving component of the beam pump unit 100. The accelerometer 206 is configured to measure an acceleration of the polished rod 124 or another moving component of the beam pump unit 100 during operation. The acceleration may be used to determine the velocity (e.g., stroke per minute) and/or the displacement of the polished rod 124. The acceleration may be measured as an analog voltage value (e.g., in millivolts), which may be converted to a digital value by the ADC. The digital value may be transmitted to the computing system (e.g., the wellsite gateway) using the transceiver. For example, the digital value may be transmitted using BLE communication. The data (e.g., digital voltage values) may be time-stamped. The digital voltage values may be converted to acceleration, velocity, and/or displacement values using a calibration chart/table that is specific to the accelerometer 206. The acceleration, velocity, and/or displacement values may be used as part of the dynamometer survey. The dynamometer survey may be used to analyze volumetric efficiency of the subsurface pump and/or the well, as well as the mechanical integrity and operating efficiency of the subsurface pump.

The signals from the strain gauge 202, gyroscope 204, and accelerometer 206 may be preprocessed, etc., using one or more preprocessors (three are shown: 207A, 207B, 207C). For example, the raw data for the surface dynacard may include load on the polished rod 124 and position of the polished rod 124 with respect to the stroke cycle. In an example, the load data may be calibrated and converted from voltage (mV) to load (klb), and the acceleration data may be converted from three-axis acceleration sensor voltage (mV) to position (in). The load and positional data are time-synchronized by the data acquisition firmware. The load data are denoised, e.g., using a median filter supplemented by an outlier-elimination technique, segmented, and interpolated with a fixed number of upstroke and downstroke points for each segmented dynacard. Then, the clean segmented load and position data can be plotted against each other to produce commonly known surface dynacard.

From the orientation and acceleration data, the position of the polished rod 124 may be determined, and associated with a time ("timestamp"). Likewise, the load data (referring to load incident on the polished rod 124) may be associated with a timestamp. The load and position data may be correlated using the timestamps, and a plot of load versus position may be generated. This is the surface dynamometer card or "dynacard", as indicated at 208.

Next, as will be described in greater detail below, a machine learning (ML) algorithm 210 may be employed to detect an operating condition and/or diagnose operating issues associated with the beam pump unit 100 and generate a diagnostic code, as at 212. The ML algorithm 210 may be trained using a training corpus of surface dynacards associated with various operation conditions, including operating normally and various different possible anomalous operations and their causes. As such, the ML algorithm 210 may be configured to recognize pump health and diagnose pumping issues using only the surface dynacard, or potentially using the surface dynacard in combination with pressure measurements of the casing head and/or tubing head. This may avoid the drawbacks of the wave equation and the structural information for the beam pump unit 100 and/or the well components, which is often needed to infer the downhole conditions from the surface system's behavior. In other embodiments, the output from the ML algorithm 210 may be combined with the wave equation outputs to form a more robust interpretation of the downhole conditions based at least in part on the surface system's behavior.

Figure 3:
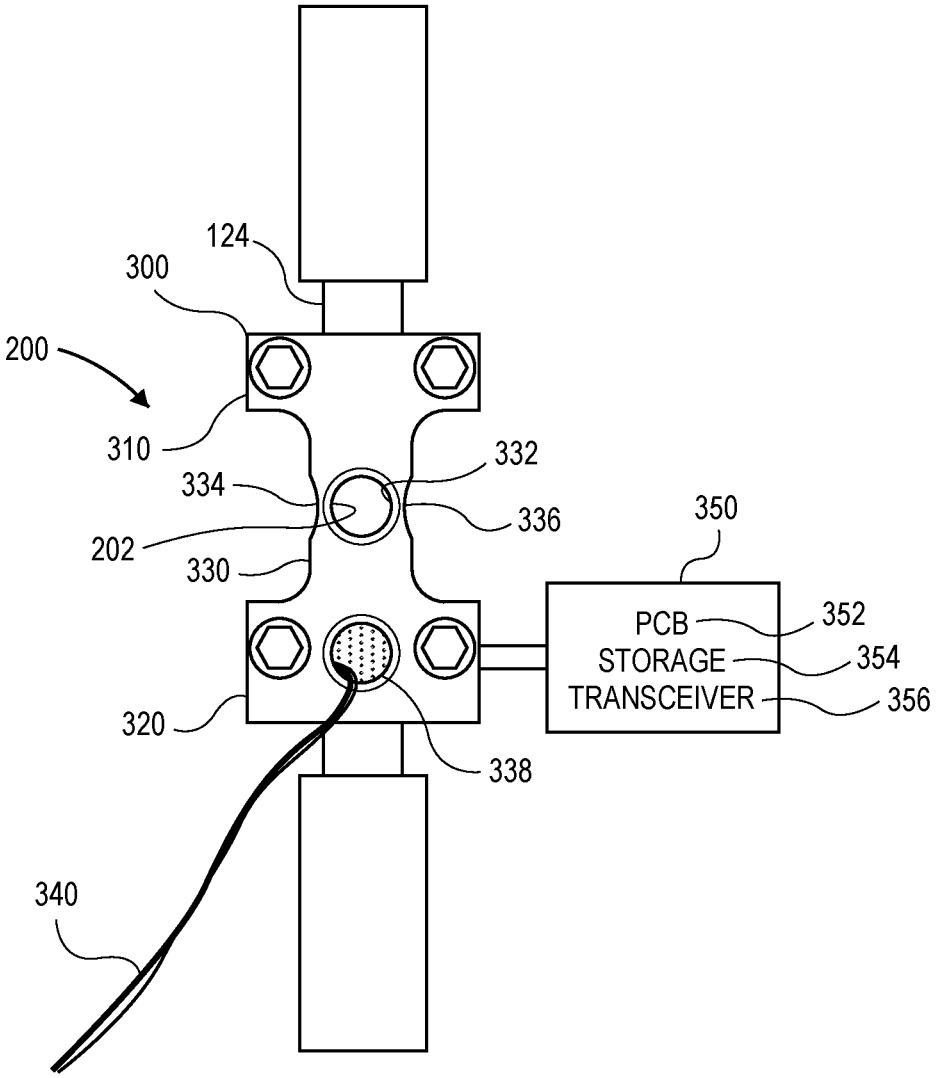
FIG. 3 illustrates a top view of an integrated sensor in the system, according to an embodiment.

FIG. 3 illustrates a top view of at least a portion of the integrated sensor 200, according to an embodiment. The integrated sensor 200 may be configured to be coupled to the polished rod 124 (e.g., between the carrier bar 122 and the stuffing box 125).

The integrated sensor 200 may include a body 300 in the shape of an I-beam. The body 300 may include a first (e.g., upper) clamping mechanism 310, a second (e.g., lower) clamping mechanism 320, and a base 330 positioned between the upper and lower clamping mechanisms 310, 320. The upper and lower clamping mechanisms 310, 320 may be configured to clamp (i.e., grip) the polished rod 124 at two different points along the polished rod 124 that are axially-offset from one another. The clamping mechanisms 310, 320 may be installed on (e.g., coupled to) the polished rod 124 without disassembling the polished rod 124 from the beam pump unit 100 (e.g., without disassembling the polished rod 124 from the carrier bar 122, the stuffing box 125, and/or or the sucker rod 150).

A first (e.g., base) bore 332 may be formed at least partially through the base 330, creating first and second thin segments 334, 336 of the base 330 on opposing sides of the bore 332. The first thin segment 334 may be between the first bore 332 and a first side of the base 330, and the second segment 336 may be between the first bore 332 and a second side of the base 330. A second (e.g., clamping mechanism) bore 338 may be formed at least partially through the first clamping mechanism 310 and/or the second clamping mechanism 320. An electrical component 340 may be positioned at least partially within the second bore 338. In the embodiment shown, the electrical component 340 may be or include one or more wires. For example, the wire(s) may connect to the strain gauge 202 and/or to a circuit (e.g., a matching circuit). In another embodiment, the electrical component 340 may be or include a circuit (e.g., a matching circuit) that is positioned at least partially within the second bore 338.

A cross-sectional shape of the first bore 332 may be circular. A minimum thickness of the first and/or second thin segment(s) 334, 336 may be from about 1 μm to about 1 mm, about 10 μm to about 1 mm, or about 100 μm to about 1 mm. In at least one embodiment, the strain gauge 202 may be positioned at least partially within the first bore 332. For example, the strain gauge 202 may be coupled to an inner surface of the base 330 that defines the first bore 332. In another embodiment, the strain gauge 202 may include a first portion that is coupled to or embedded at least partially within the first thin segment 334, and a second portion that is coupled to or embedded at least partially within the second thin segment 336.

The strain gauge 202 may measure the relative displacement of the upper and lower clamping mechanisms 310, 320 from one another, which may be proportional to the load applied to the polished rod 124. Further, the base 330 may include cutouts, e.g., on either lateral side of the first bore 332, which may serve to reduce a thickness of the thin segments 334, 336, thereby decreasing the rigidity of the base 330. As a result, the sensitivity of the strain gauge 202 increases.

Referring to the strain gauge 202 in greater detail, the strain gauge 202 may be or include a sensor, the resistance of which varies with the applied force/load. The strain gauge 202 thus converts force, pressure, tension, weight, etc., into a change in electrical resistance that can then be measured and converted into strain. When external forces are applied to a stationary object (e.g., the polished rod 124), stress and strain are the result. Stress is defined as the object's internal resisting forces, and strain is defined as the displacement and deformation that occur. The strain may be or include tensile strain and/or compressive strain, distinguished by a positive or negative sign. Thus, the strain gauge 202 may be configured to measure expansion and contraction of the polished rod under static or dynamic conditions.

The (e.g., absolute) change of length $\Delta l$ of the polished rod 124 is the difference between a length l of a section of the polished rod 124 at the time of the measurement and an original length thereof (i.e., the reference length $l_0$). Thus, $\Delta l = l - l_0$. Strain$=\Delta l/l=\%$ elongation. The strain is caused by an external influence or an internal effect. The strain may be caused by a force, a pressure, a moment, a temperature change, a structural change of the material, or the like. If certain conditions are fulfilled, the amount or value of the influencing quantity can be derived from the measured strain value.

In one embodiment, the strain gauge 202 may be or include a metallic foil-type strain gauge that includes a grid of wire filament (e.g., a resistor) having a thickness less than or equal to about 0.05 mm, about 0.025 mm, or about 0.01 mm. The wire filament may be coupled (e.g., bonded) directly to the strained surface of the base 330 and/or the polished rod 124 by a thin layer of epoxy resin. When the load is applied to the polished rod 124, the resulting change in surface length of the polished rod 124 and/or the base 330 is communicated to the resistor, and the corresponding strain is measured in terms of electrical resistance of the wire filament. The resistance may vary linearly with the strain. The wire filament and the adhesive bonding agent work together to transmit the strain. The adhesive bonding agent may also serve as an electrical insulator between the polished rod 124 and the wire filament.

In an embodiment, an enclosure 350 may be coupled to the body 300. The enclosure 350 may define an internal volume that may include the printed circuit board (PCB) 352, a data storage device 354, and/or the transceiver 356. In at least one embodiment, the strain gauge 202, the gyroscope 204, and/or the accelerometer 206 may be coupled to and/or in communication with the PCB 352, the storage device 354, the transceiver 356, or a combination thereof.

Figure 4:
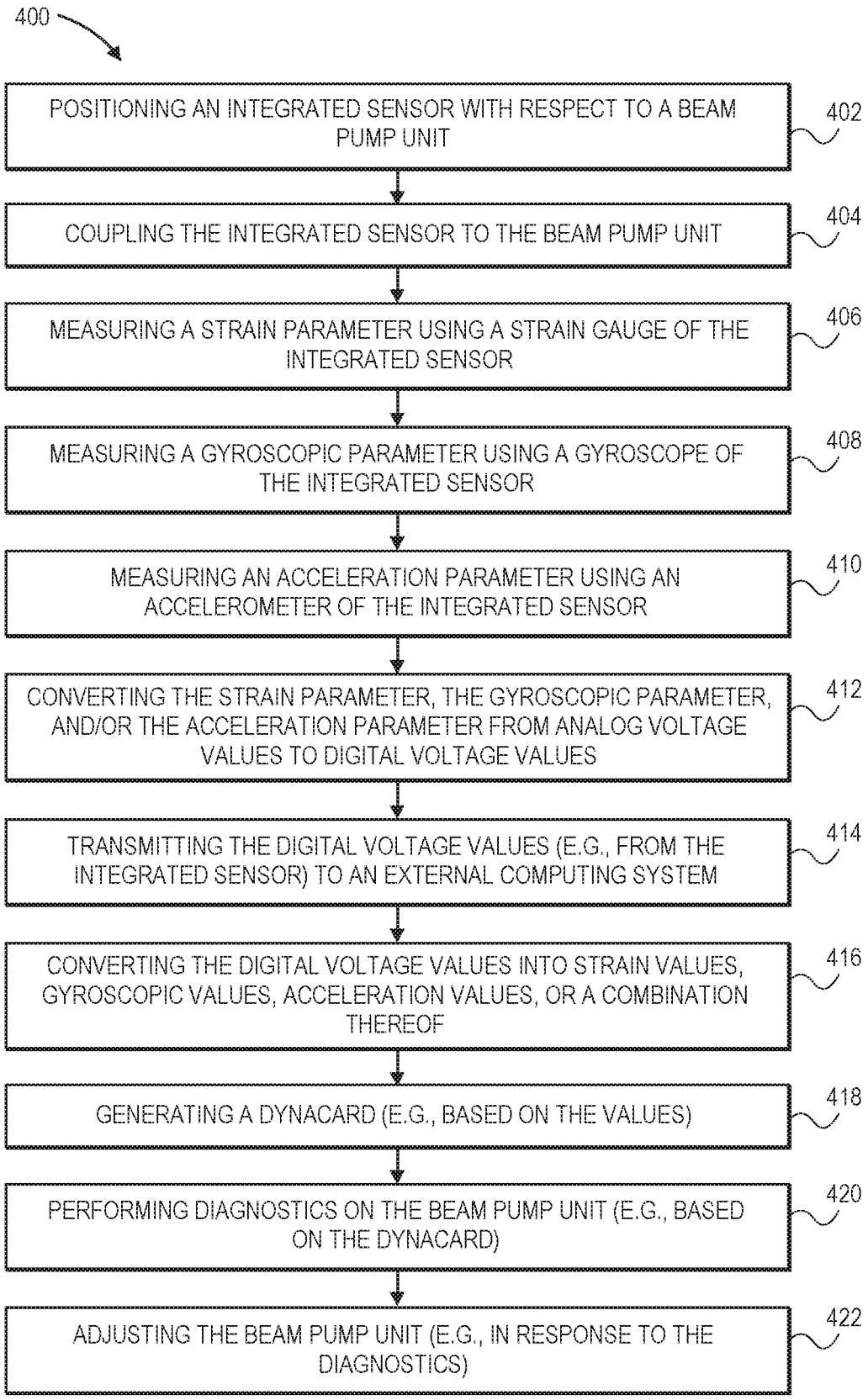
FIG. 4 illustrates a flowchart of a method for determining performance of the beam pump unit, according to an embodiment.

FIG. 4 illustrates a flowchart of a method 400 for determining the performance of the beam pump unit 100, according to an embodiment. An illustrative order of the method 400 is provided below; however, one or more steps may be performed in a different order, repeated, or omitted.

The method 400 may include positioning the integrated sensor 200 with respect to the beam pump unit 100, as at 402. More particularly, this may include positioning the strain gauge 202, the gyroscope 204, and/or the accelerometer 206 with respect to the polished rod 124. As mentioned above, the clamping mechanisms 310, 320 may be axially-offset with respect to the polished rod 124. This step may be performed without disassembling the polished rod 124 from the beam pump unit 100 (e.g., from the carrier bar 122, the stuffing box 125, and/or or the sucker rod 150).

The method 400 may also include coupling the integrated sensor 200 to the beam pump unit 100, as at 404. This may include coupling the strain gauge 202, the gyroscope 204, and/or the accelerometer 206 to the polished rod 124. For example, the clamping mechanisms 310, 320 may be coupled/clamped to the polished rod 124. This step may be performed without disassembling the polished rod 124 from the beam pump unit 100 (e.g., from the carrier bar 122, the stuffing box 125, and/or or the sucker rod 150).

The method 400 may also include measuring a strain parameter using the strain gauge 202, as at 406. This step may be performed while the polished rod 124 is moving (e.g., cycling up and down). As mentioned above, the length of the polished rod 124 may vary slightly as the polished rod 124 moves up and down due to the varying load. Because the integrated sensor 200 (e.g., the body 300) is clamped to the polished rod 124 at two axially-offset locations, the length of the strain gauge 202 may also vary in a proportionate amount to polished rod 124. As the strain gauge 202 varies in length, the resistance of the strain gauge 202 varies. The variation in the resistance causes the voltage to vary. The strain parameter may be or include an analog voltage value.

The method 400 may also include measuring a gyroscopic parameter using the gyroscope 204, as at 408. This step may be performed while the beam pump unit 100 is operating. For example, this step may be performed while the polished rod 124 is moving (e.g., cycling up and down). The gyroscopic parameter may be or include an analog voltage value.

The method 400 may also include measuring an acceleration parameter using the accelerometer 206, as at 410. This step may be performed while the beam pump unit 100 is operating. For example, this step may be performed while the polished rod 124 is moving (e.g., cycling up and down). The acceleration parameter may be or include an analog voltage value.

The method 400 may also include converting the strain parameter, the gyroscopic parameter, and/or the acceleration parameter from analog voltage values to digital voltage values, as at 412. This step may be part of the preprocessing at 207A-207C. This step may be performed by an ADC that is coupled to and/or in communication with the integrated sensor 200. For example, the ADC may be part of the circuit 352 in the enclosure 350. In at least one embodiment, this step may be omitted, and the remainder of the method 400 may be performed with analog voltage values.

The method 400 may also include transmitting the digital voltage values from the integrated sensor 200 to an external computing system, as at 414. For example, the transceiver 356 in the enclosure 350 may transmit the digital voltage values to the external computing system. The digital voltage values may include/represent the data measured by the strain gauge 202, the gyroscope 204, the accelerometer 206, or a combination thereof.

The method 400 may also include converting the digital voltage values into strain values, gyroscopic values, acceleration values, or a combination thereof, as at 416. This step may include comparing the digital voltage values from the strain gauge 202 to a chart that includes corresponding strain values and/or load values. This step may also or instead include comparing the digital voltage values from the gyroscope 204 to a chart that includes corresponding orientation values and/or an angular velocity values. For example, a digital voltage value of 1 volt may be equal to 10 radians per second, and a digital voltage value of 2 volts may be equal to 20 radians per second. This step may also or instead include comparing the digital voltage values from the accelerometer 206 to a chart that includes corresponding acceleration values. For example, a digital voltage value of 1 volt may be equal to 10 meters/second/second, and a digital voltage value of 2 volts may be equal to 20 meters/second/second. The velocity, displacement, and/or position of the polished rod 124 may be determined from the acceleration. One or more of the foregoing steps may be repeated to obtain a plurality of strain values, load values, orientation values, angular velocity values, acceleration values, position values, displacement values, or a combination thereof that are captured at different times and during different points in the movement of the polished rod 124.

The method 400 may also include generating the dynacard 208, as at 418. The dynacard 208 may be based at least partially upon the strain values, load values, orientation values, angular velocity values, acceleration values, position values, displacement values, or a combination thereof. In at least one embodiment, the dynacard may include load versus position data.

The method 400 may also include performing the diagnostics 212 on the beam pump unit 100, as at 420. The diagnostics 212 may be performed based at least partially upon the dynacard 208.

The method 400 may also include adjusting the beam pump unit 100, as at 422. More particularly, the beam pump unit 100 may be adjusted based at least partially upon the diagnostics 212 to improve the volumetric efficiency, mechanical integrity, and/or operating efficiency.

Figure 5:
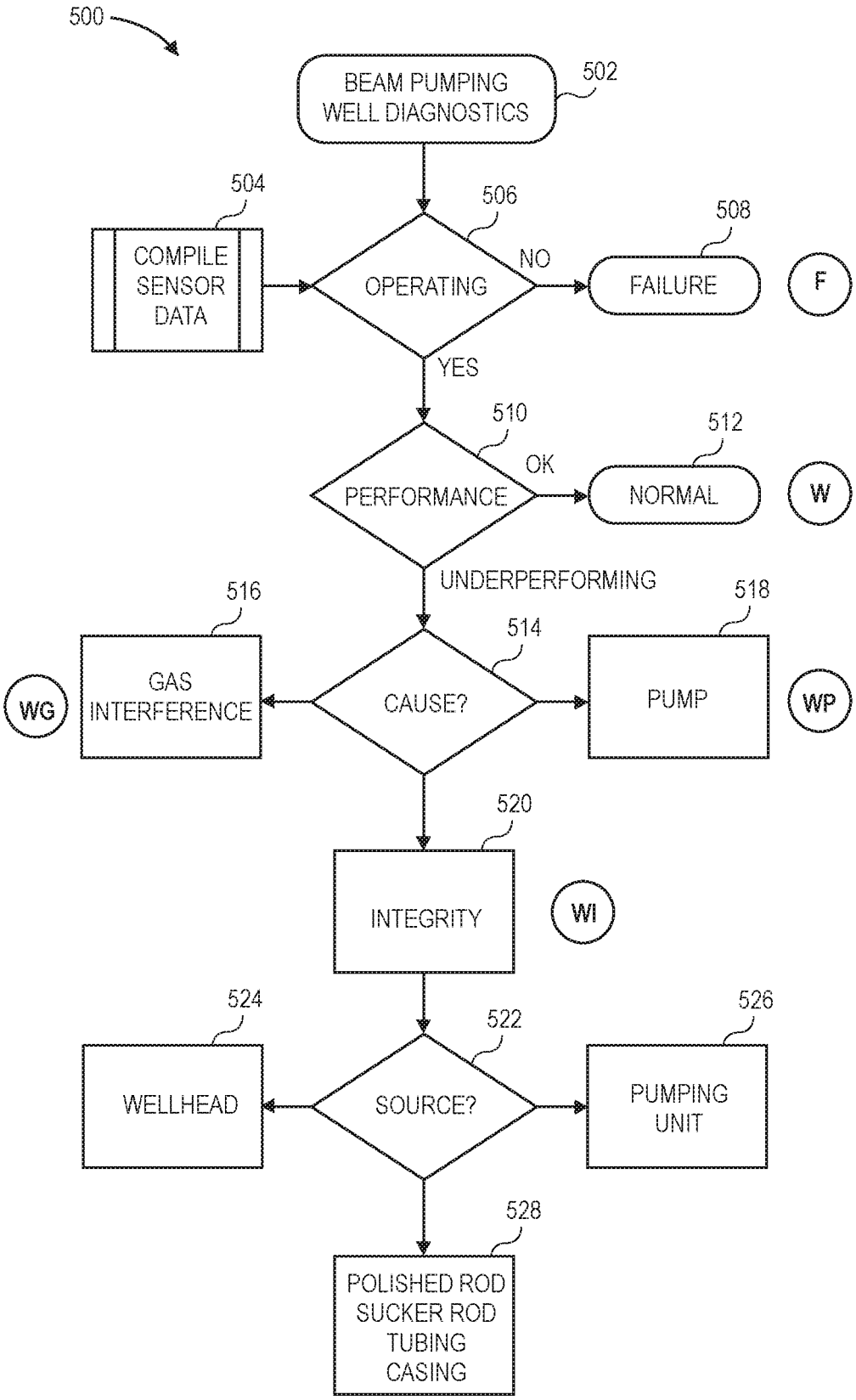
FIG. 5 illustrates a flowchart of a method for performing diagnostics on the beam pump unit, according to an embodiment.

FIG. 5 illustrates a flowchart of a method 500 for performing diagnostics on the beam pump unit 100, according to an embodiment. The method 500 may include receiving sucker rod pump well diagnostics, as at 502. The method 500 may also include receiving and/or compiling the measurements from the strain gauge 202, the gyroscope 204, and the accelerometer 206, as at 504. This may include receiving the strain value, the load value, the orientation value, the angular velocity value, the acceleration value, or a combination thereof (from step 416). In another embodiment, this may include receiving the dynacard 208 (from step 418).

The method 500 may also include determining whether the beam pump unit 100 is operating, as at 506. This determination may be based at least partially upon the data received at 502, 504, or both. If the beam pump unit 100 is not operating, it may be determined that the beam pump unit 100 is failing, as at 508. If the beam pump unit 100 is operating, then the method 500 may include determining whether the beam pump unit 100 is operating at or above a predetermined level, as at 510. If the performance is at or above the predetermined level, then it may be determined that the beam pump unit 100 is operating normally, as at 512. If the performance is below the predetermined level, the method 500 may include determining a cause for the underperformance, as at 514. The cause may be or include gas interference (as at 516), the pump (as at 518), the well integrity (as at 520), or a combination thereof. If the cause is inadequate well integrity, then the method 500 may include determining a source of the inadequate well integrity, as at 522. The source may be or include the wellhead (as at 524), the pumping unit (as at 526), the polished rod sucker tubing casing (as at 528), or a combination thereof.

The foregoing description, for purpose of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosed embodiments and various embodiments with various modifications as are suited to the particular use contemplated.

What is claimed is:

1. An apparatus, comprising:

a body comprising:

a first clamping mechanism configured to grip a tubular member of a beam pump unit at a first location along the tubular member;

a second clamping mechanism configured to grip the tubular member at a second location along the tubular member that is axially-offset from the first location; and a base positioned at least partially between the first and second clamping mechanisms, wherein the base comprises first and second wide sections with a narrow section therebetween, wherein a first bore is defined in the narrow section, and a second bore is defined in the first or second wide section;

a strain gauge coupled to the base and configured to measure a strain on the tubular member as the tubular member moves, wherein the strain gauge is positioned at least partially within the first bore;

an electrical component positioned at least partially within the second bore;

a gyroscope configured to measure an orientation, an angular velocity, or both of the beam pump unit as the beam pump unit operates;

an accelerometer configured to measure an acceleration of the beam pump unit as the beam pump unit operates; and a computing system configured to perform operations, the operations comprising:

determining a position of the tubular member based at least partially upon the orientation and the acceleration at a plurality of different times;

determining a load on the tubular member based at least partially upon the strain at the plurality of different times;

correlating the position and the load at the plurality of different times; and generating a plot of the position versus the load at the plurality of different times.

2. The apparatus of claim 1, wherein the tubular member comprises a polished rod of the beam pump unit.

3. The apparatus of claim 2, wherein the gyroscope is coupled to the body.

4. The apparatus of claim 2, wherein the accelerometer is coupled to the body.

5. The apparatus of claim 1, wherein the base has the first bore formed at least partially therethrough, such that the base defines first and second thin segments on either side of the bore.

6. The apparatus of claim 5, wherein a cross-sectional shape of the first bore is circular.

7. The apparatus of claim 5, wherein the first thin segment is formed between the first bore and a side of the base, and wherein the side of the base has a recess formed therein proximate to the first bore.

8. The apparatus of claim 5, wherein the strain gauge is coupled to an inner surface of the body that defines the first bore.

9. The apparatus of claim 5, wherein the strain gauge comprises:

a first portion coupled to or embedded within the first thin segment; and a second portion coupled to or embedded within the second thin segment.

10. The apparatus of claim 1, further comprising:

an enclosure coupled to the body;

a circuit positioned within the enclosure, wherein the circuit is configured to receive measurements from the strain sensor, the gyroscope, and the accelerometer; and a transceiver positioned within the enclosure, wherein the transceiver is configured to wirelessly transmit the measurements to an external computing system.

11. A system, comprising:

a body comprising:

a first clamping mechanism configured to grip a rod of a beam pump unit at a first location along the rod;

a second clamping mechanism configured to grip the rod at a second location along the rod that is axially-offset from the first location; and a base positioned at least partially between the first and second clamping mechanisms, wherein the base comprises first and second wide sections with a narrow section therebetween, wherein the base has a first bore formed at least partially through the narrow section such that the base defines first and second thin segments on either side of the first bore, and wherein the base has a second bore formed at least partially through the first or second wide section;

a strain gauge positioned at least partially within the first bore, wherein the strain gauge is configured to measure a strain on the rod as the rod moves;

an electrical component positioned at least partially in the second bore;

a gyroscope coupled to the body and configured to measure an orientation, an angular velocity, or both of the rod as the rod moves; and an accelerometer coupled to the body and configured to measure an acceleration of the rod as the rod moves;

an enclosure coupled to the body;

a circuit positioned within the enclosure, wherein the circuit is configured to receive measurements from the strain gauge, the gyroscope, and the accelerometer;

a transceiver positioned within the enclosure, wherein the transceiver is configured to wirelessly transmit the measurements to an external computing system; and a computing system configured to perform operations, the operations comprising:

determining a position of the rod based at least partially upon the orientation and the acceleration at a plurality of different times;

determining a load on the rod based at least partially upon the strain at the plurality of different times;

correlating the position and the load at the plurality of different times; and generating a plot of the position versus the load at the plurality of different times.

12. The system of claim 11, wherein the body is in the shape of an I-beam.

13. The system of claim 12, wherein the first and second thin segments each have a thickness that is less than 1 mm.

14. The system of claim 13, wherein a side of the base defines a recess, and wherein the first thin segment is between the recess and the first bore.

15. The system of claim 14, wherein the strain is measured as an analog voltage value, wherein the circuit converts the analog voltage value to a digital voltage value, and wherein the transceiver transmits the digital voltage value.

16. A method, comprising:

coupling an integrated sensor to a polished rod of a beam pump unit, wherein the integrated sensor comprises:

a body comprising:

a first clamping mechanism configured to be coupled to the polished rod at a first location along the polished rod;

a second clamping mechanism configured to be coupled the polished rod at second location along the polished rod that is axially-offset from the first location; and a base positioned at least partially between the first and second clamping mechanisms, wherein the base comprises first and second wide sections with a narrow section therebetween, wherein a first bore is defined at least partially through the narrow section, and wherein a second bore is defined at least partially through the first or second wide section;

a strain gauge positioned at least partially within the first bore;

an electrical component positioned at least partially within the second bore;

a gyroscope coupled to the body; and an accelerometer coupled to the body;

measuring a strain parameter using the strain gauge;

measuring a gyroscopic parameter using the gyroscope;

measuring an acceleration parameter using the accelerometer;

determining a position of the polished rod based at least partially upon the gyroscopic parameter and the acceleration at a plurality of different times;

determining a load on the polished rod based at least partially upon the strain parameter at the plurality of different times;

correlating the position and the load at the plurality of different times; and generating a plot of the position versus the load at the plurality of different times.

17. The method of claim 16, wherein the strain parameter, the gyroscopic parameter, and the acceleration parameter are measured while the polished rod is moving up, down, or both.

18. The method of claim 17, wherein the strain parameter, the gyroscopic parameter, and the acceleration parameter comprises analog voltage values, and further comprising converting the analog voltage values to digital voltage values using a circuit, wherein the circuit is positioned within an enclosure that is coupled to the body.

19. The method of claim 18, further comprising transmitting the digital voltage values to an external computing system using a transceiver positioned within the enclosure.

20. The method of claim 19, further comprising:

converting the digital voltage values into a strain value, a gyroscopic value, and an acceleration value; and generating a dynacard based at least partially upon the strain value, the gyroscopic value, and the acceleration value.

* * * * *